US005920743A

United States Patent [19]

Yamada et al.

[11] Patent Number: 5,920,743

[45] Date of Patent: Jul. 6, 1999

[54] SHEET FEEDING APPARATUS HAVING MEANS FOR DETERMINING THE LEADING EDGE OF A SHEET

[75] Inventors: Masakatsu Yamada, Kawasaki; Minoru Yokoyama; Takeshi Kohno, both of Yokohama, all of Japan

[73] Assignee: Canon Kabushiki Kaisha, Tokyo, Japan

[21] Appl. No.: 08/904,627

[22] Filed: Aug. 1, 1997

Related U.S. Application Data

[63] Continuation of application No. 08/669,827, Jun. 26, 1996, Pat. No. 5,701,547, which is a continuation of application No. 08/122,935, Sep. 20, 1993, abandoned.

[30] Foreign Application Priority Data

Sep. 28, 1992 [JP] Japan ..... 4-281098

[51] Int. Cl.[6] ..... G03G 21/00

[52] U.S. Cl. ..... 399/1; 347/104; 399/16; 399/384

[58] Field of Search ..... 399/1, 16, 23, 399/38, 384, 385; 347/104, 140, 139, 3; 358/401, 498

[56] References Cited

U.S. PATENT DOCUMENTS

| | | | |
|---|---|---|---|
| Re. 34,685 | 8/1994 | Negishi et al. | 399/384 X |
| 4,963,941 | 10/1990 | Negishi et al. | 399/384 |
| 5,212,531 | 5/1993 | Monma et al. | 399/16 |
| 5,216,471 | 6/1993 | Kajita et al. | 399/385 |
| 5,420,701 | 5/1995 | Terashima et al. | 358/498 |
| 5,701,547 | 12/1997 | Yamada et al. | 399/1 |

*Primary Examiner*—S. Lee
*Attorney, Agent, or Firm*—Fitzpatrick, Cella, Harper & Scinto

[57] ABSTRACT

A sheet feeding apparatus includes a guiding path for guiding a sheet, a detector for detecting the presence/absence of the sheet in the guiding path, a power-supply switch for turning on and off a power supply, and a determination device for determination whether the sheet comprises a rolled sheet or a cut sheet according to whether the detector detects or does not detect the sheet, respectively, when the power-supply switch has been turned on. A rolled sheet holder for holding the rolled sheet and covering an insertion port for leading the cut sheet or the rolled sheet to a feeding device.

8 Claims, 14 Drawing Sheets

SHEET FEEDING APPARATUS HAVING MEANS FOR DETERMINING THE LEADING EDGE OF A SHEET

CROSS REFERENCE TO RELATED APPLICATIONS

This is a continuation of U.S. application Ser. No. 08/669,827 filed Jun. 26, 1996, now U.S. Pat. No. 5,701,547, which is a continuation of U.S. application Ser. No. 08/122,935, filed Sep. 20, 1993, now abandoned.

BACKGROUND OF THE INVENTION

1. Field of the Invention

This invention relates to a sheet feeding apparatus which may be used for a printer, a facsimile apparatus or the like, and more particularly, to a sheet feeding device for feeding cut paper, rolled paper, an original, etc.

2. Description of the Related Art

FIG. 14 illustrates a schematic configuration of a conventional thermal recorder which uses rolled recording paper. In FIG. 14, thermal print head 1031 performs printing on recording paper. The recording paper is grasped and fed by platen roller 1032 and thermal print head 1031. Spring 1033 presses thermal print head 1031 against platen roller 1032. Reflection-type sensor 1034 detects the presence/absence of the recording paper. In addition, recording-paper guide roller 1035 and rolled thermosensitive recording paper 1036 are also shown.

In the above-described configuration, sensor 1034 detects only the presence/absence of recording paper, and does not detect the leading edge and the trailing edge of the recording paper. That is, sensor 1034 detects the presence of the recording paper when it is set, and detects the absence of the recording paper when the recording paper either is not set or has been used up.

Conventionally, in the printer unit of a facsimile apparatus or the like in which thermosensitive rolled paper or thermal transfer paper is used, oblique movement of the recording paper is one of the main causes of a paper jam. In some cases, the printing position shifts due to the oblique movement of the recording paper, thereby causing misprinting of necessary information.

In order to prevent the oblique movement of the recording paper, a sprawling sheet is inserted between respective sheets of rolled paper to provide parallelism with a feeding roller.

A conventional facsimile apparatus or a printer may be configured as illustrated in FIG. 15. Rolled thermosensitive recording paper, 1251, is fed by platen roller 1250, and is selectively heated by recording head 1252, to form an image. A sheet of recording paper 1251 on which the image has been formed is cut at the trailing edge of the image by cutters 1253*a* and 1253*b*, and the cut sheet is discharged.

In the above-described configuration, as shown in FIG. 16, end mark 1258 is printed on the back, opposite to the recording surface of recording paper 1251, over a range of about 1 m from the trailing edge of recording paper 1251 with a width of approximately 20–30 mm.

End-mark sensor 1256 is provided at a position facing the back of recording paper 1251 and corresponding to the position of end mark 1258 in the lateral direction. Accordingly, when a sufficient length of recording paper 1251 remains, end-mark sensor 1256 detects the white background of the recording paper 1251. When the length of the remaining portion of recording paper 1251 is approximately 1 m, end-mark sensor 1256 detects the black end mark 1258. Black plate 1257, shown in FIG. 15, is provided at a position facing end-mark sensor 1256, across recording paper 1251, so that the black plate is detected if recording paper 1251 is absent.

The facsimile apparatus performs a normal recording operation while end-mark sensor 1256 detects the white background of recording paper 1251. When end mark 1258 is detected during a recording operation, the recording operation is continued for the page being printed, and the subsequent recording operation is then stopped. In an apparatus having an intercepting function, the contents of pages after the recording operation is stopped are stored in a memory of the apparatus, and the stored recording is performed when new recording paper has been loaded. When end-mark sensor 1256 detects black at the start of the operation, the receiving operation is not performed at all, or is intercepted at the start of the operation.

When sheet-like recording paper is used, it is necessary to detect the position of the leading edge of the recording paper in order to determine the position to start recording. When the length of data to be recorded is shorter than the length of the recording paper, it is necessary to detect the trailing edge of the recording paper in order to discharge the recording paper after the completion of recording. When the length of data to be recorded is longer than the length of the recording paper, since the recording paper will be used up during the recording operation, it is necessary to prevent idle printing by interrupting recording after detecting the trailing edge of the recording paper.

In order to perform the above-described operations, it is necessary to provide sensors to precisely detect both the leading edge and the trailing edge of recording paper, in addition to providing a sensor for detecting the presence/absence of the recording paper, thereby causing an increase in the production cost.

The above-described method of using a sprawling sheet has the following problems:

(1) Oblique movement of recording paper cannot be prevented if parallelism is not provided between the sprawling sheet and the sheet-feeding roller (platen roller). Therefore, high accuracy in dimensions is required.

(2) It is difficult to set the recording paper.

In the above-described approach of using an end-mark sensor, since end-mark sensor 1256 detects both the state of the presence of end mark 1258 and the state of the absence of recording paper by the detection of the color black, it is impossible to discriminate between the two states.

Therefore, in the case of a facsimile apparatus, even if end mark 1258 is detected while receiving and recording an abnormally long page, platen roller 1250 continues to rotate when the amount of the contents to be recorded is longer than the remaining amount of recording paper, and part of the contents will not be recorded.

In addition, since the position of the end mark differs between manufacturers, the end mark cannot be detected when recording paper of a different manufacturer is used. Hence, it is impossible to know that the remaining amount of recording paper is small until the trailing edge of the recording paper passes. As a result, even if recording paper is suddenly used up during a recording operation, the platen roller continues to rotate until recording of the page being recorded is completed, and part of the contents will not be recorded.

Even if the contents to be recorded are not recorded on recording paper in the above-described manner, the transmitter will determine that the page having a missing portion has been completely transmitted. The page having the missing portion cannot be recovered even if intercepting is performed from the subsequent page.

When platen roller 1250 idly rotates, it directly contacts recording head 1252, thereby causing an increase in the load. Hence, the driving system for recording must be strengthened more than necessary.

When platen roller 1250 idly rotates, the trailing edge of the recording paper remains in a space between sheet guides 1255 and 1254. Since recording is completed in that state, and the recording paper is cut, a piece of the recording paper remains within the apparatus.

SUMMARY OF THE INVENTION

It is an object of the present invention to provide an inexpensive recorder in which both the leading edge and the trailing edge of recording paper, as well as the presence of the recording paper, are detected, so that both rolled paper and cut sheets of paper may be used as the recording paper.

It is another object of the present invention to provide a recorder in which rolled paper, fed to recording means, does not move obliquely.

It is still another object of the present invention to provide a recorder which can detect the trailing edge of the rolled paper and the absence of the rolled paper by a single reflection-type photosensor.

These and other objects, advantages and features of the present invention will become more apparent from the following detailed description of the preferred embodiments taken in conjunction with the accompanying drawings.

BRIEF DESCRIPTION OF THE DRAWINGS

FIG. 1(*a*) is a diagram illustrating the schematic configuration of a principal portion of the recorder, and FIG. 1(*b*) is a block diagram of the recorder;

FIG. 8(*a*) is a cross-sectional view illustrating the schematic configuration of a principal portion of the recorder, and FIG. 8(*b*) is a diagram illustrating the circuitry of the principal portion;

DETAILED DESCRIPTION OF THE PREFERRED EMBODIMENTS

Figure 1A:
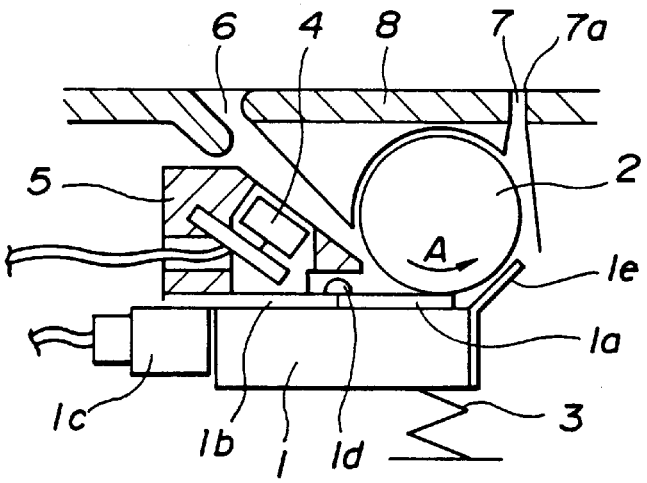
FIGS. 1(*a*) and 1(*b*) illustrate a recorder according to a first embodiment of the present invention.
Figure 1:
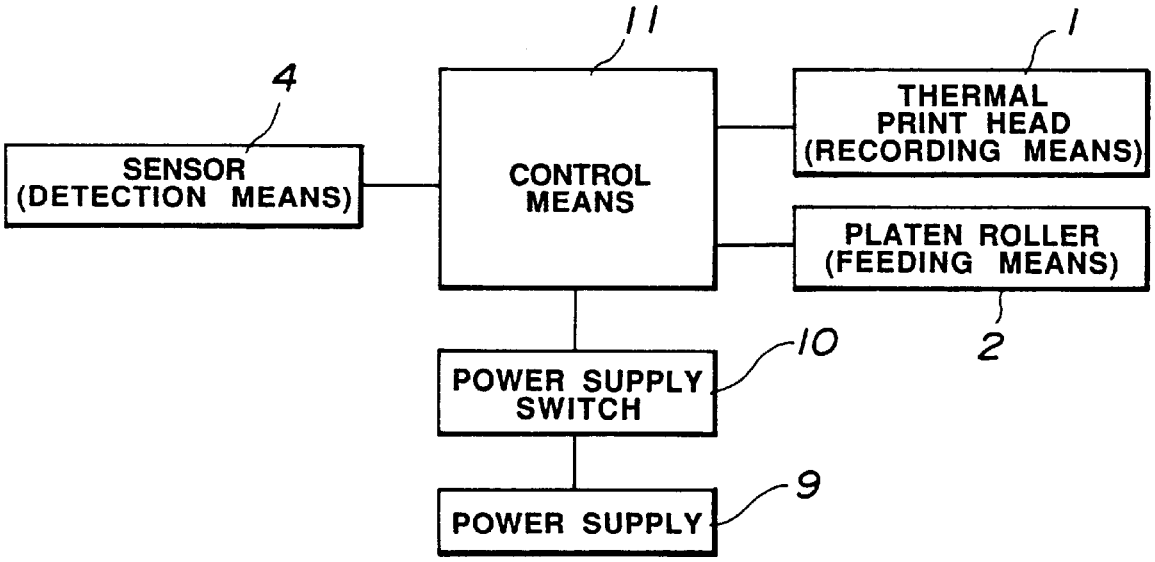

FIGS. 1(*a*) and 1(*b*) are diagrams which represent characteristics of a first embodiment of the present invention. In FIGS. 1(*a*) and 1(*b*), thermal print head 1 serves as recording means to perform printing using heating elements. Platen roller 2 serves as feeding means for grasping recording paper between it and thermal print head 1, and for feeding the grasped recording paper. Spring 3 presses thermal print head 1 against platen roller 2. Reflection-type sensor 4 serves as detection means for detecting the presence/absence of recording paper. Recording-paper guide 5 forms a part of a path for the recording paper, and also protects circuit substrate 1*b* of the thermal print head. Recording-paper insertion port 6 is used for inserting recording paper therein. Recording-paper discharging port 7 discharges recording paper. Reference numeral 8 represents the case of the apparatus. Power supply 9 operates the apparatus. Power-supply switch 10 turns on and off power supply 9. Control means 11 controls the operations of thermal print head 1, platen roller 2, sensor 4 and the like.

Thermal print head 1 includes ceramic substrate 1*a*, having the heating elements, circuit substrate 1*b*, connector 1*c*, wire-bonded portion 1*d*, for connecting circuit substrate 1*b* and ceramic substrate 1*a*, and common cover 1*e* for guiding the recording paper after printing.

Recording-paper guide 5 protects circuit substrate 1*b* and wire-bonded portion 1*d*, and determines the path for recording paper. Recording-paper guide 5 has an opening for sensor 4 at a midsection of the path for recording paper. Both sensor 4 and recording-paper guide 5 are mounted on thermal print head 1.

Next, a description will be provided of the operations of the first embodiment when using cut paper and when using rolled paper.

In the Case of Using Cut Paper

The following describes two methods of setting cut paper.

In a first method, pressure for thermal print head 1 is first released by a release mechanism (not shown), cut paper is inserted from recording-paper insertion port 6, and pressure to thermal print head 1 is applied again when the leading edge of the cut paper reaches recording-paper discharge port 7. This method however has two problems. First, the cut paper obliquely moves if it is set in an inclined state. Second, when the distance between the recording position where thermal print head 1 contacts platen roller 2 and the position of recording-paper discharge port 7 is long, the leading edge of the cut paper has a long margin, thereby causing a decrease in the length of a recorded portion of the cut paper. Accordingly, the following second method of setting cut paper is more effective.

First, cut paper is inserted until its leading edge contacts the recording position where thermal print head 1 contacts platen roller 2. Thus, the leading edge of the cut paper becomes parallel to platen roller 2, whereby oblique movement of the cut paper is corrected. When the cut paper has been inserted from recording-paper insertion port 6 and has passed through the position of sensor 4, the presence of recording paper is detected by sensor 4. In order to provide a certain time allowance from the time when the presence of the recording paper has been detected until the time when the leading edge of the cut paper reaches the recording position, platen roller 2 is rotated in the direction of arrow A by a predetermined amount x after approximately 0.5 second–1 second, so that the leading edge of the cut paper enters a space between thermal print head 1 and platen roller 2. The predetermined amount x of the rotation of platen roller 2 in the direction of arrow A provides a margin at the leading edge of the cut paper. Hence, by determining the amount x, the length of the margin can be shortened.

After the completion of setting of the cut paper, the process proceeds to a recording operation. Printing is performed by thermal print head 1 based on recording information while feeding the cut paper by rotating platen roller 2 in the direction of arrow A. Thereafter, when the trailing edge of the cut paper has passed through sensor 4, the absence of recording paper is detected. After the detection, platen roller 2 is rotated by an amount corresponding to the distance between sensor 4 and the recording position to discharge the cut paper.

As described above, in the case of using cut paper, sensor 4 also has the function of detecting the leading edge and the trailing edge of the cut paper. In this case, since sensor 4 is configured so as to be integral with thermal print head 1, the distance between the position of sensor 4 and the recording position can be maintained constant, for example, irrespective of variations in the mounting position of thermal print head 1. Hence, the above-described method has an advantage in that the leading edge and the trailing edge (in particular, the trailing edge) of cut paper can be precisely determined.

In the Case of Using Rolled Paper

Rolled paper is set while releasing the pressure against thermal print head 1, since the leading edge of rolled paper is not necessarily aligned as in the case of cut paper. After releasing the pressure, the leading edge of rolled paper is fed from recording-paper insertion port 6 to recording-paper discharging port 7, and pressure is again applied to thermal print head 1. The position of recording-paper discharging port 7 corresponds to the cut position for the rolled paper, and the rolled paper is cut by hand. Only the first sheet of the rolled paper need to be set, and the subsequent sheets need not be set. Sensor 4 only determines the presence/absence of recording paper, and does not detect the leading edge or the trailing edge of the recording paper. After completing the setting of the rolled paper, sensor 4 detects the presence of the recording paper, whereby it becomes possible to perform a recording operation. After completing the printing operation, the recording paper is fed until a recorded portion of the rolled paper passes through recording-paper discharging port 7, which corresponds to the cut position, and leaves the apparatus, whereby the recording operation is completed. In the case of rolled paper, sensor 4 detects the presence of the recording paper even after completing the recording operation, in order to prepare for the subsequent recording operation.

A cutter with which rolled paper may be cut by hand may be formed at edge portion 7*a* of recording-paper discharge port 7.

Figure 2:
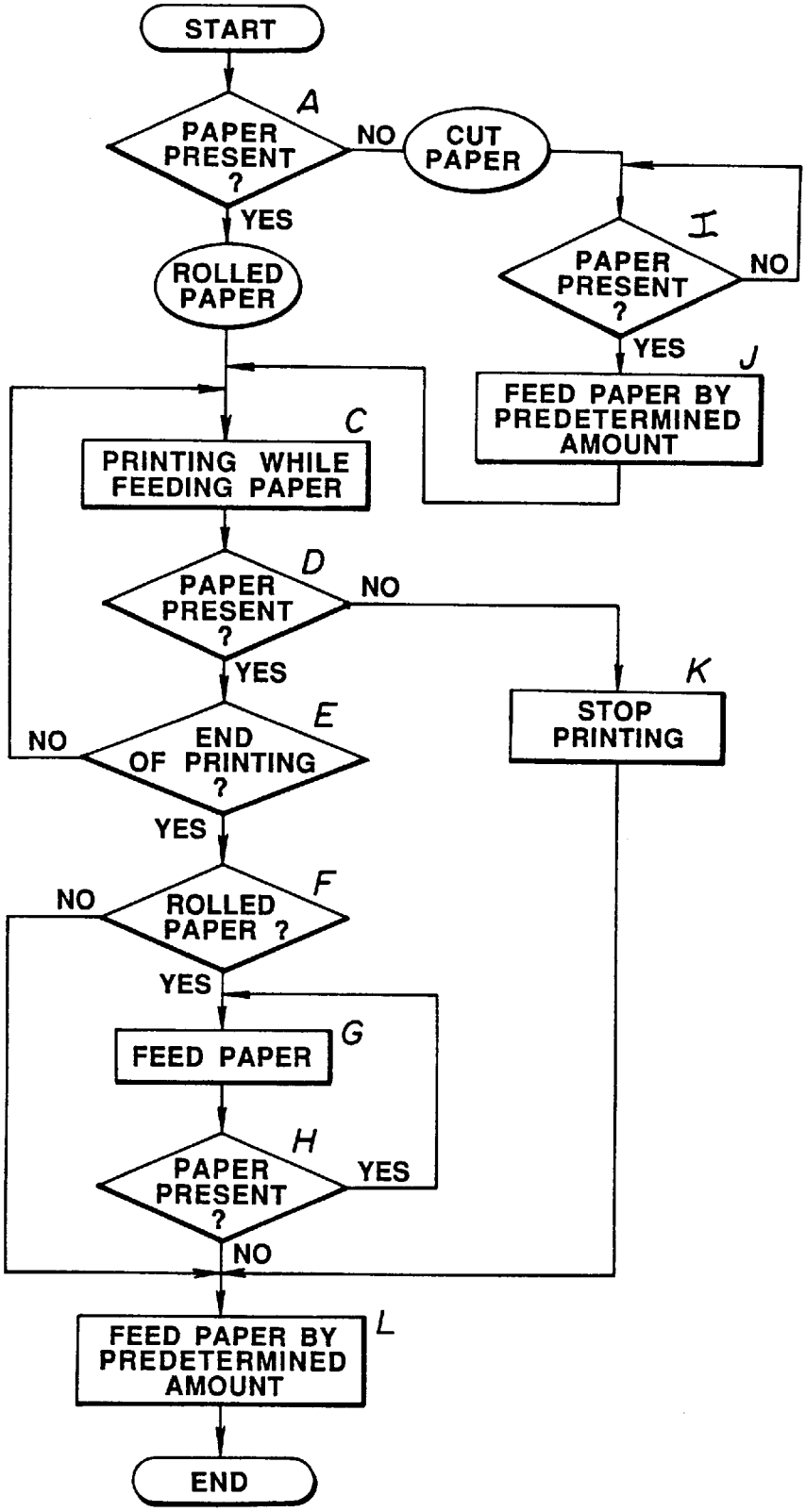
FIG. 2 is a flowchart illustrating the operation of the recorder.

FIG. 2 is a flowchart illustrating the recording operation of the first embodiment. A description will now be provided of the operation with reference to this flowchart.

In a state in which power supply 9 is turned on (step A), the presence/absence of recording paper is determined (step B). In the case of rolled paper, if the rolled paper is set in a state in which power supply 9 is turned off, the presence of the recording paper is always detected when power supply 9 has been turned on, and the process proceeds to step C.

In the case of cut paper, since the cut paper is inserted after power supply 9 has been turned on, the absence of the recording paper is detected in step B, and the process proceeds to step I. When the cut paper has been inserted, the presence of the recording paper is detected in step I. After the lapse of a predetermined time period, platen roller 2 is rotated by a predetermined amount in step J in order to cause the cut paper to enter a space between platen roller 2 and thermal print head 1.

After preparing for printing as described above, printing corresponding to image information is performed while feeding the recording paper (step C). During the printing operation, the presence/absence of the recording paper is determined (step D). If the recording paper is used up, the printing operation is stopped (step K), and the recording paper is fed by a predetermined amount and is discharged (step L). If the printing operation is completed in the state of the presence of the recording paper as a result of determination in step E, it is determined whether rolled paper or cut paper is used (step F). In the case of rolled paper, the paper is fed by a predetermined amount (step L), and the process is terminated.

In the case of cut paper, the presence/absence of the recording paper is determined (step H) while feeding the recording paper (step G). The recording paper is fed by a predetermined amount after it has been determined that the paper is absent (step L), and the process is terminated.

Second Embodiment

Figure 3:
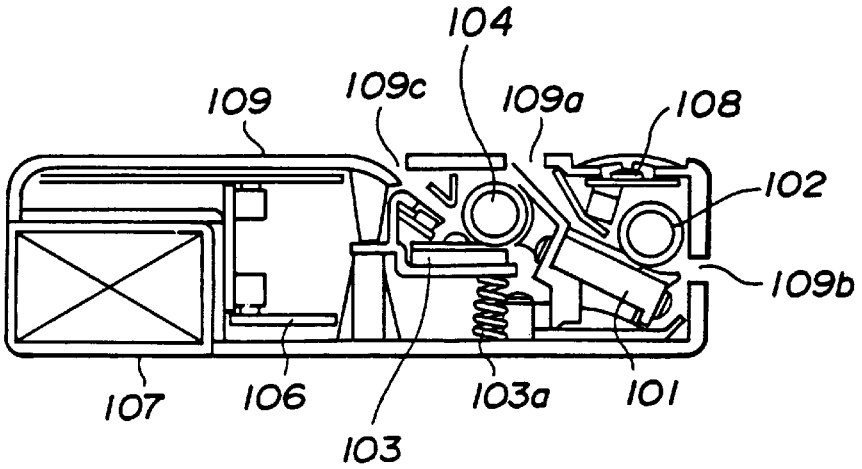
FIGS. 3(*a*) through 3(*c*) are cross-sectional views illustrating the configuration of a recorder according to a second embodiment of the present invention.
Figure 3:
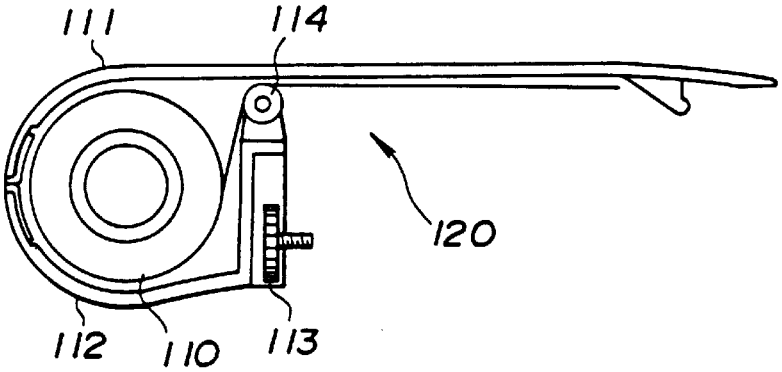
Figure 3:
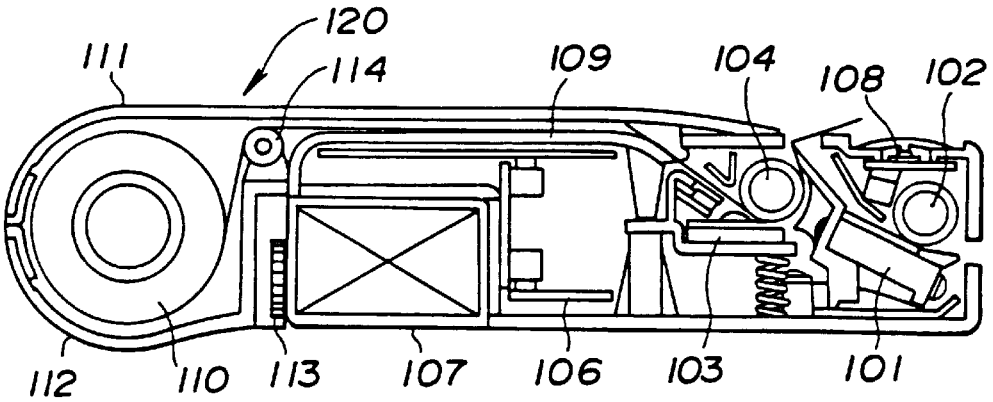

FIGS. 3(*a*) through 5 illustrate a second embodiment of the present invention.

The greatest cause for oblique movement of recording paper is lack of parallelism between the axis of the roll of recording paper and a recording-paper feeding roller. A description will be provided of the most difficult case for providing the parallelism in which the recording-paper roller and a recording-paper-roll holder are provided as separate units.

FIG. 3(*a*) illustrates the facsimile apparatus used in the second embodiment. This facsimile apparatus is portable, and includes contact sensor 101 and CS (contact-sensor) roller 102 as a reading unit. A recording unit includes platen roller 104, serving as feeding means, thermal print head 103, serving as recording means, and spring 103*a*. A driving system drives CS roller 102 and platen roller 104 by a stepping motor (not shown) to feed an original and recording paper, respectively. Reference numeral 106 represents a control unit for electrical signals and an NCU (network control unit). Reference numeral 107 represents a Ni—Cd battery, serving as a driving source. Reference numeral 108 represents an operation unit. Main-body cover 109 includes entrance 109*a* for reading, exit 109*b* for reading, and entrance 109*c* for recording. A normal transmission operation can be performed in this state. In a receiving operation, however, it is necessary to provide a cutter for thermosensitive paper. Accordingly, although the facsimile apparatus of this type is compact and covenient for a user who mainly performs transmission operations and seldom performs receiving operations, it is inconvenient for a user who mainly performs receiving operations.

FIG. 3(*b*) illustrates recording-rolled-paper holder 120, serving as a feeding unit which can be combined with the facsimile unit shown in FIG. 3(*a*). In FIG. 3(*b*), there are shown thermosensitive recording rolled paper 110, recording-paper cover 111, holder 112, screw 113 for screwing holder 120 to the main-body unit shown in FIG. 3(*a*), and recording-paper guide roller 114, serving as guide means.

FIG. 3(*c*) is a diagram illustrating the combined state of the main-body unit and the holder unit.

Figure 4:
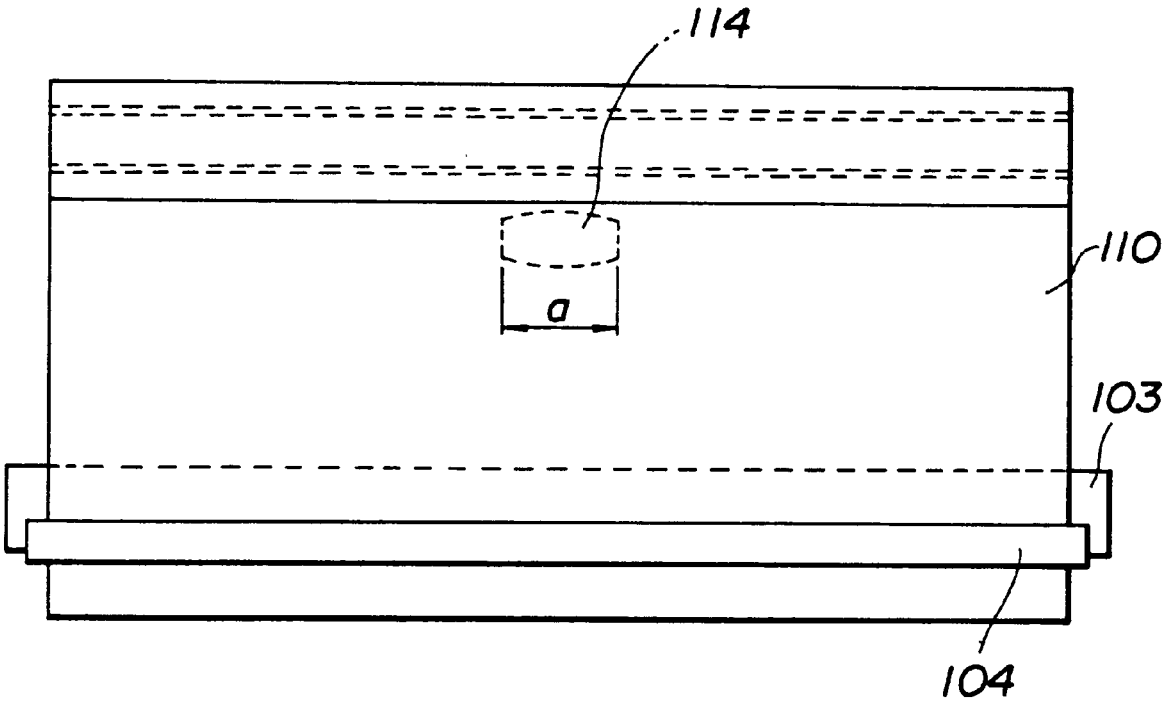
FIG. 4 is a plan view of the recorder of the second embodiment.

FIG. 4 is a plan view of a running system for recording paper. As shown in FIG. 4, recording-paper guide roller 114 is present only in the vicinity of the central portion in the direction of the width of recording paper. Thermal print head 103 is a line head whose width substantially equals the width of recording paper.

Figure 5:
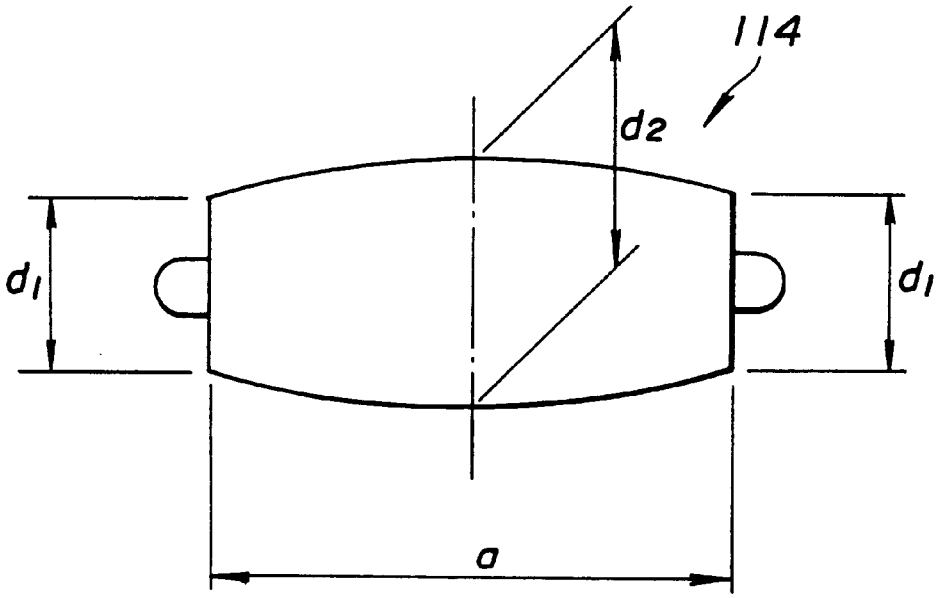
FIG. 5 is a diagram illustrating the details of a principal portion of the recorder of the second embodiment.

FIG. 5 illustrates recording-paper guide roller 114. The following relationship between $d_1$ and $d_2$ is desirable:

$$d_1 \leqq d_2.$$

The length "a" is assumed, for example, to be about 50 mm.

Principle of Preventing Oblique Movement of Recording Paper

Figure 6:
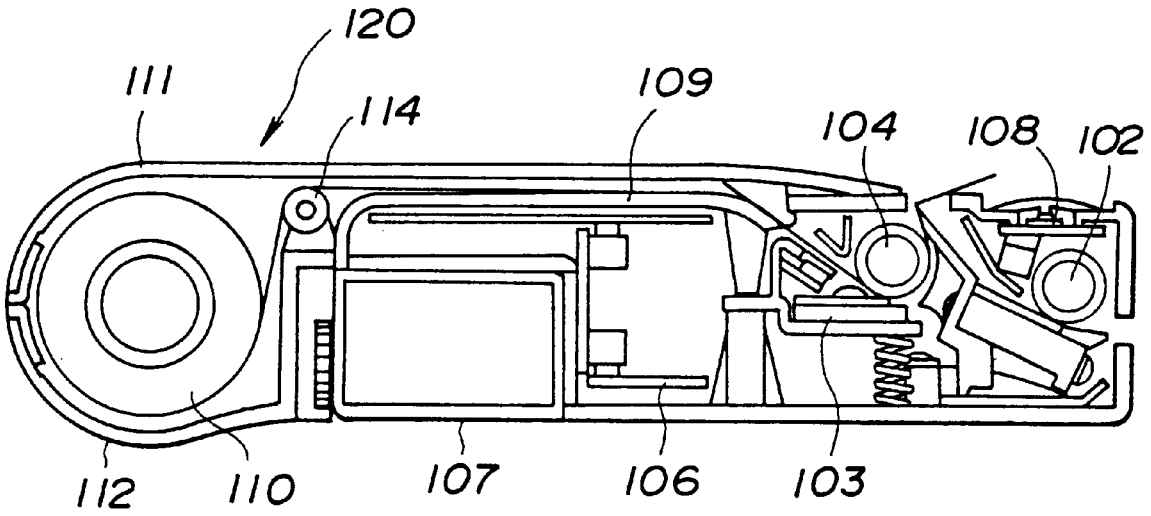
FIGS. 6(*a*) and 6(*b*) are diagrams illustrating the principles of the operation of the recorder of the second embodiment.
Figure 6:
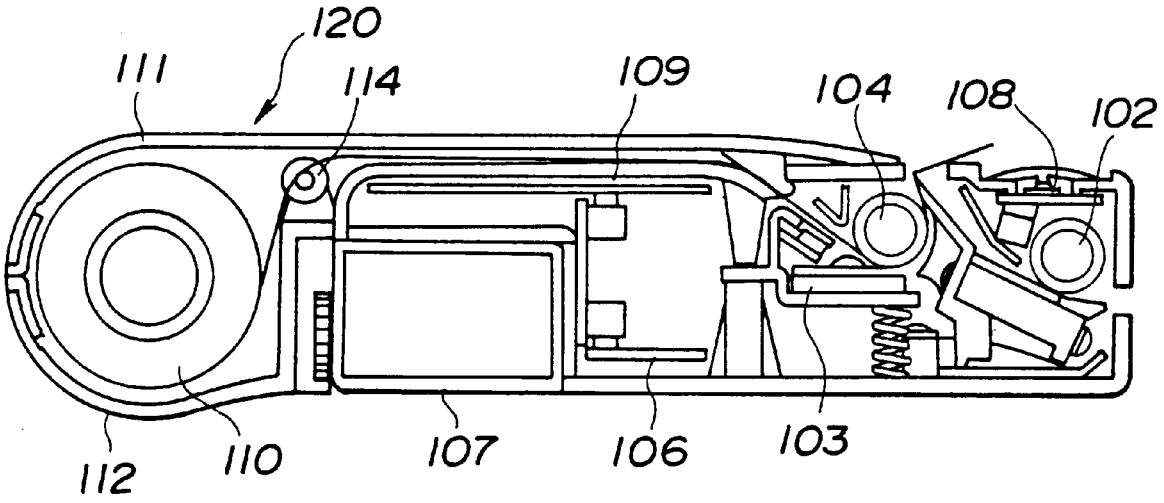

In a recording operation, recording paper is fed by platen roller 104 while being heated by thermal print head 103. At that time, a back tension is produced due to the weight of the rolled paper, whereby the recording paper is stretched along the guide unit. Accordingly, as shown in FIG. 6(*a*), the recording paper is stretched along recording-paper guide roller 114 at the central portion. At other portions, however, since recording-paper guide roller 114 is absent, the recording paper is stretched so that the paper path is shortened, as shown in FIG. 6(*b*). Since the elasticity of the recording paper is very small, the tension of the recording paper is maximized at the central portion.

Figure 7:
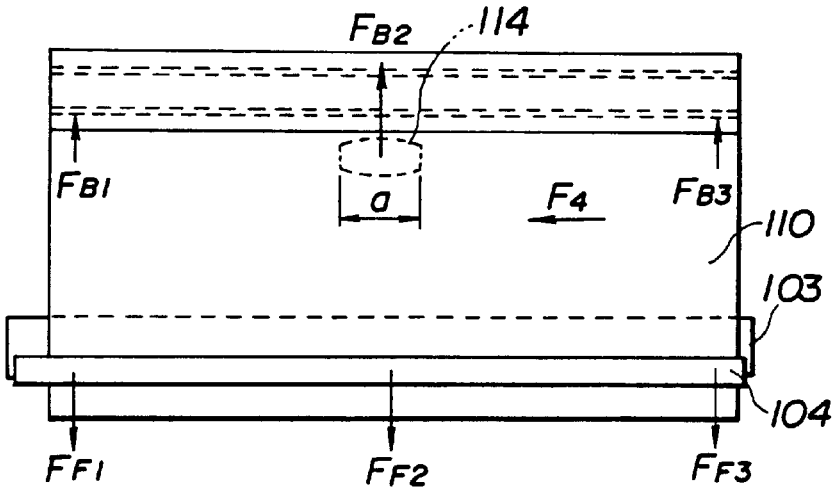
FIGS. 7(*a*) through 7(*c*) are diagrams illustrating the operation of the recorder of the second embodiment.
Figure 7:
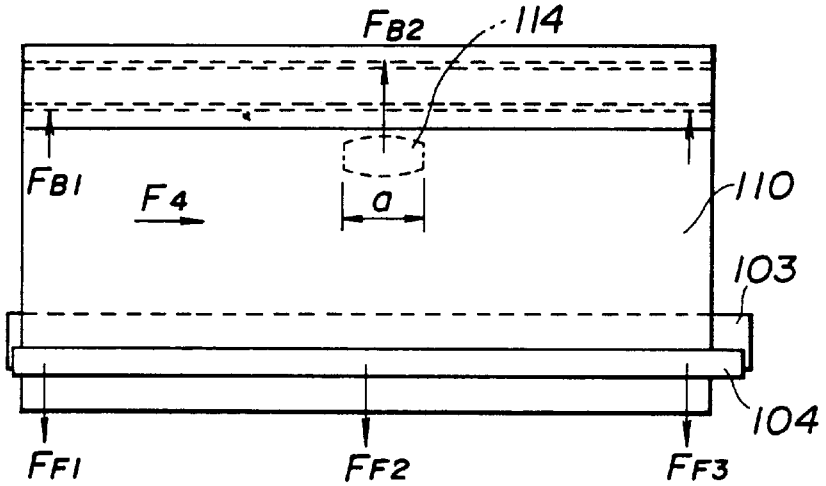
Figure 7:
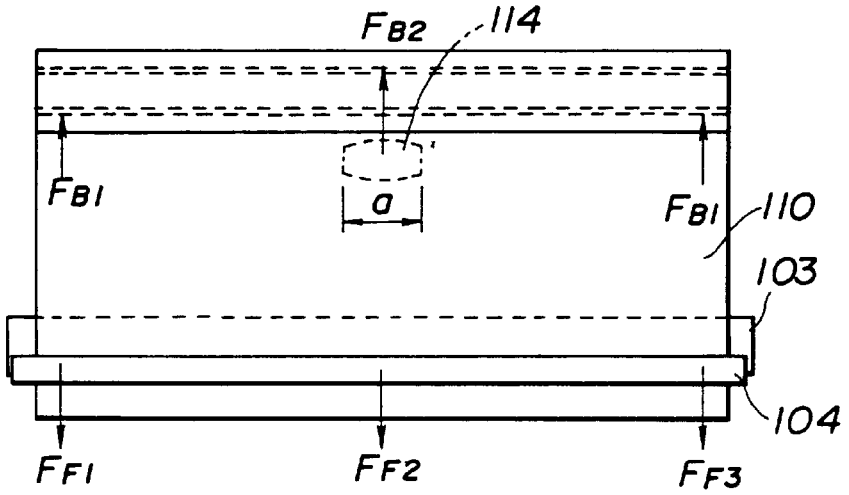

FIGS. 7(*a*) through 7(*c*) illustrate the behavior of the recording paper. When the recording paper shifts to the right as shown in FIG. 7(*a*), if $F_{F1}=F_{F2}=F_{F3}$, a force $F_4$ is produced toward the center since $F_{B2}>F_{B1}$, $F_{B3}$. When the recording paper shifts to the left as shown in FIG. 7(*b*), a force $F_4$ is produced toward the center by the same principle, and the recording paper is returned toward the center. When the recording paper is present at the center as shown in FIG. 7(*c*), a force $F_4$ is not produced, and therefore the recording paper is maintained at the central position.

As described above, by providing recording-paper guide roller 114, the recording paper always tends to be present at the central position.

In the second embodiment, a description has been provided of the case in which the recording unit and the rolled-paper holder unit are provided as separate units. However, also when the two units are provided within the same unit, oblique movement of recording paper will hardly occur by providing recording-paper guide roller 114.

Although in the second embodiment, the guide member comprises a roller, a member for regulating the paper path may be used instead of a rotatable member, such as a roller, if the coloring surface of recording paper is present at a side opposite to the guide member.

In the second embodiment, a method of guiding recording paper within the holder is adopted. However, by providing a member for regulating recording paper, such as a sprawling sheet or the like, and supplying the torque of the recording-paper roll with a load by lateral pressure, the relationship among back tensions $F_{B1}$, $F_{B2}$ and $F_{B3}$ may be held until the end of recording, and therefore an excellent result will be obtained.

Third Embodiment

Figure 8A:
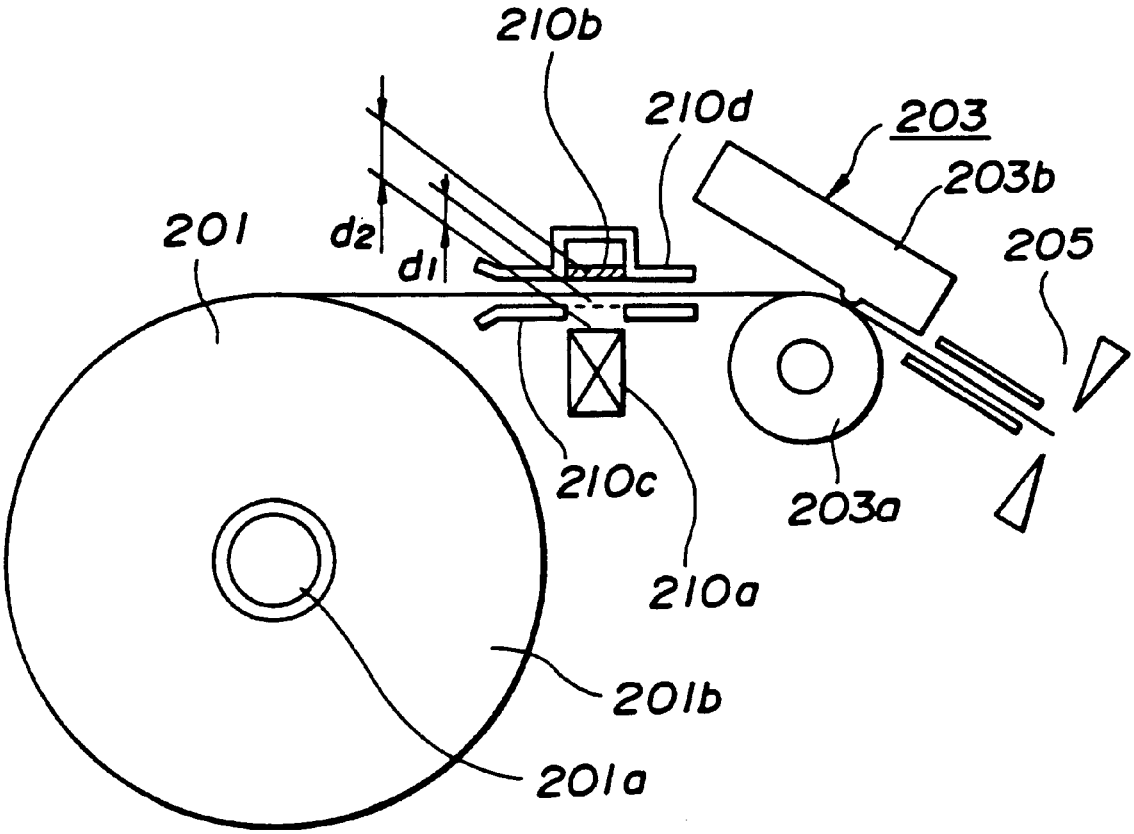
FIGS. 8(*a*) and 8(*b*) illustrate a recorder according to a third embodiment of the present invention.
Figure 8:
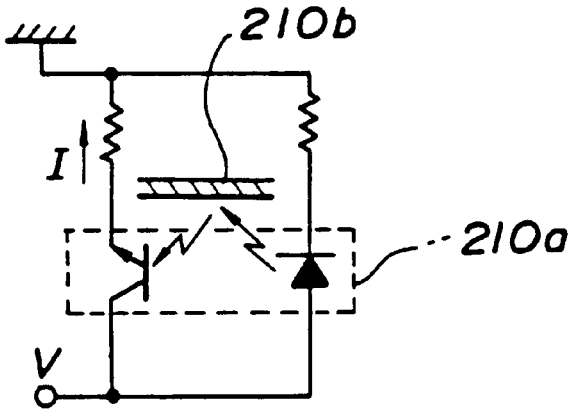
Figure 9:
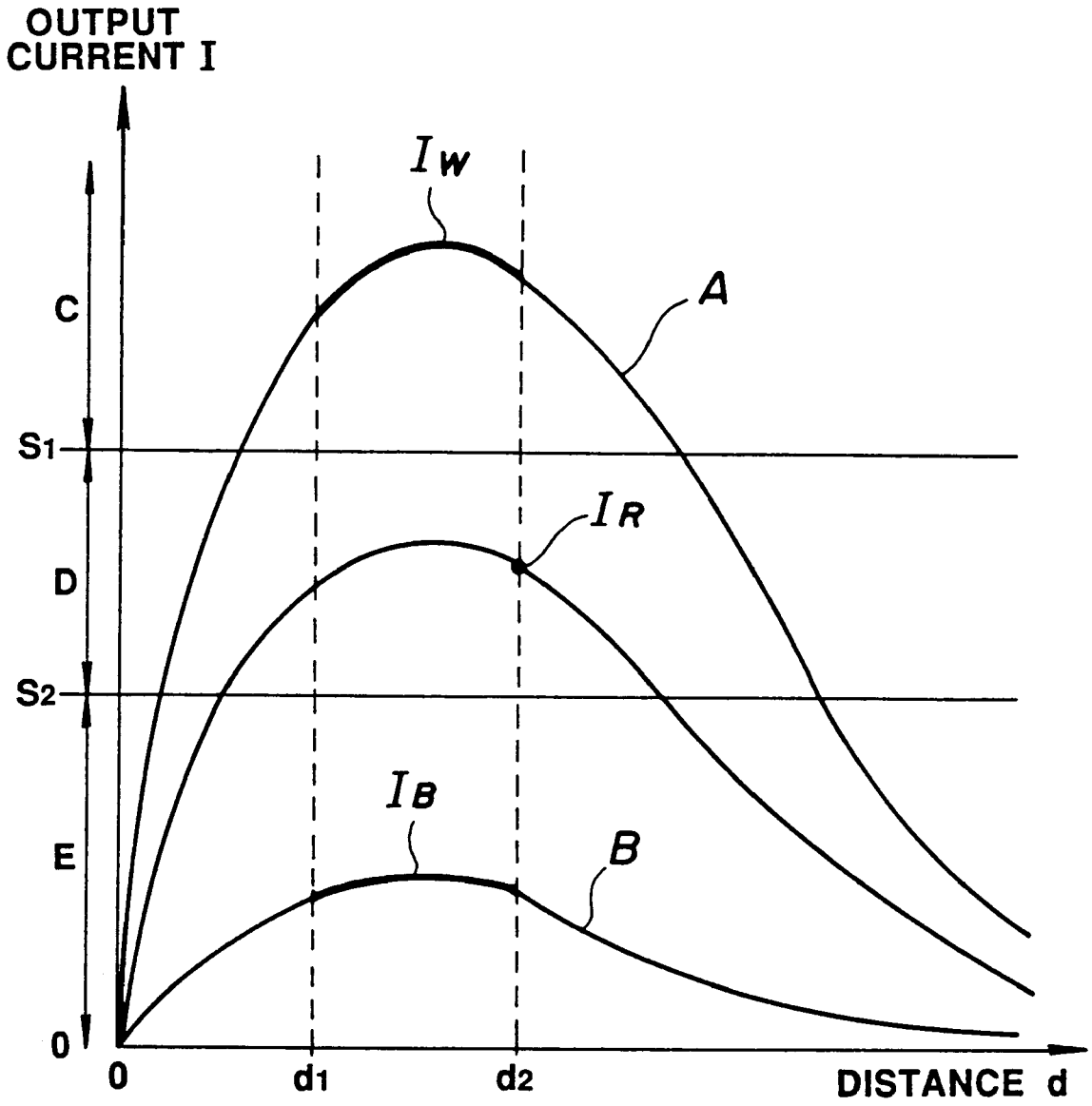
FIG. 9 is a graph illustrating the operation of the recorder of the third embodiment.
Figure 10:
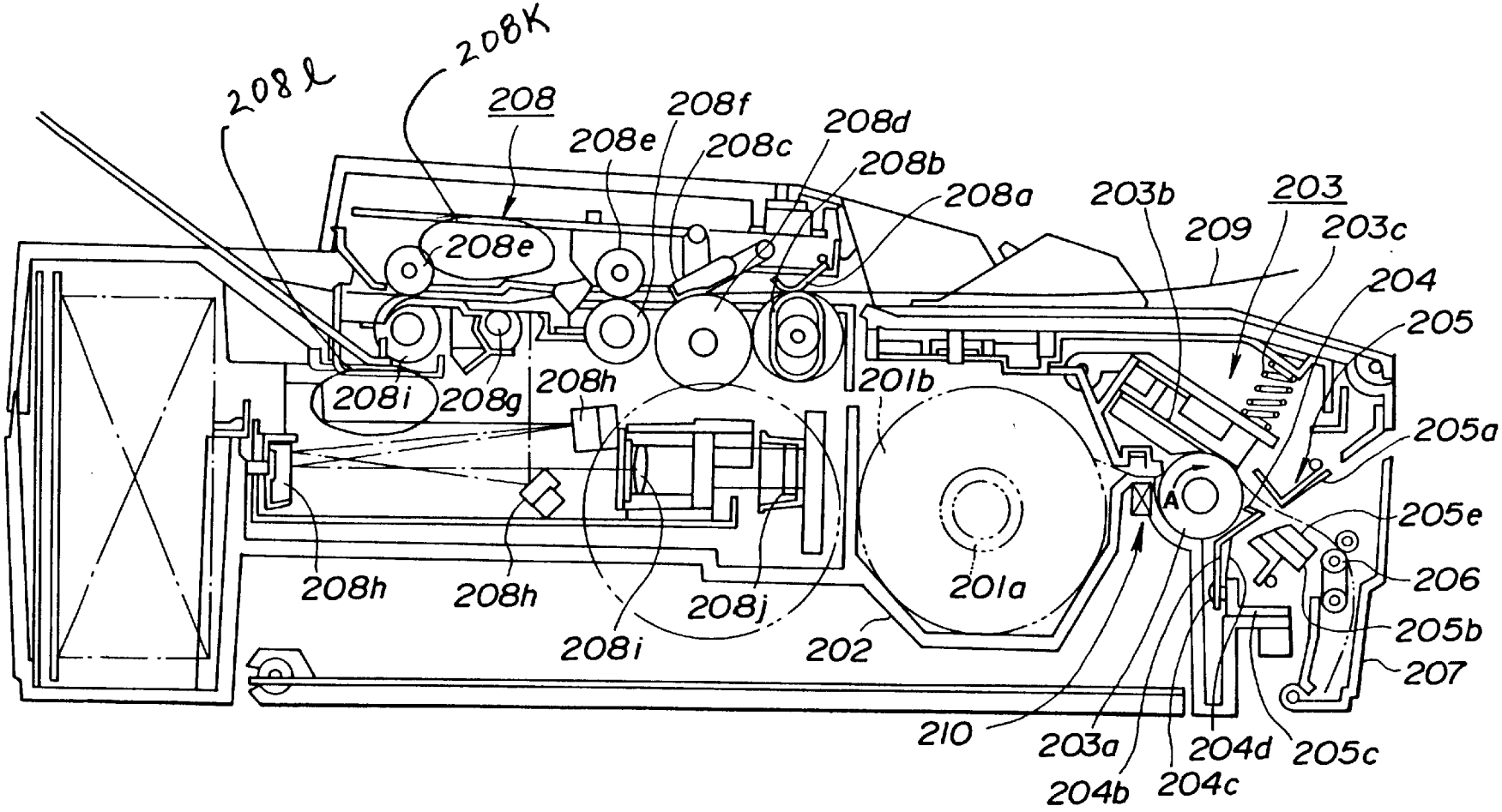
FIG. 10 is a cross-sectional view illustrating the schematic configuration of the recorder of the third embodiment.

FIG. 8(*a*) is a cross-sectional view illustrating an end-mark sensor unit of a recorder according to a third embodiment of the present invention. FIG. 8(*b*) is a diagram illustrating the circuitry of the unit shown in FIG. 8(*a*). FIG. 9 is a diagram illustrating the output current in the circuitry of the end-mark sensor unit shown in FIG. 8(*b*). FIG. 10 is a cross-sectional view of the central portion of a facsimile apparatus which includes the end-mark sensor shown in FIG. 8(*a*).

First, the configuration of the entire apparatus will be described with reference to FIG. 10. In FIG. 10, reference numeral 201 represents a thermosensitive recording sheet which colors by applying heat. Roll 201*b* obtained by winding a long thermosensitive recording sheet around inner core 201*a* is accommodated within a dropping-type roll holder 202.

An image is recorded on recording sheet 201 at recording unit 203 (to be described later). Recording sheet 201 after the image formation, is guided to cutter 205 by cutter guide 204, and is cut at the position corresponding to the trailing edge of the image, and is stacked in reversal tray 207 by discharging rollers 206.

Original-reading unit 208 is configured so that originals 209 laminated on an upper cover are individually separated by preliminary conveying roller 208*b* in pressure contact with separation pressing piece 208*a*, and separation roller 208*d* in pressure contact with separation pressing piece 208*c*, and each of the separated originals 209 is fed by feeding roller 208*f* in pressure contact with pressing roller 208*e*. The surface of the fed original 209 is iluminated by light source 208*g*, and light reflected by the surface of original 209 is guided to photoelectric conversion device 208*j*, such as a CCD (charge-coupled device) or the like, via mirrors 208*h* and lens 208*i*. An electrical signal representing the image of the original from photoelectric conversion device 208*j* is transmitted to the recording unit of the user's own apparatus in the case of a copying mode, and is transmitted to the recording unit of the communication partner's apparatus in the case of a facsimile mode (transmission mode).

Next, the configuration of each of the above-described units will be described in detail.

The above-described recording unit 203 is configured by pressing recording head 203*b*, comprising a line of heating elements, each heated by current in accordance with an image signal, against the surface of platen roller 203*a*, also serving as feeding means driven by a motor (not shown), by pressing spring 203*c*. Accordingly, by feeding recording sheet 201 by rotating platen roller 203*a* in the direction of arrow A shown in FIG. 10, and heating the heating elements in accordance with an image signal in synchronization with the rotation of platen roller 203*a*, an image is recorded on recording sheet 201.

Next, a description will be provided of the configuration of end-mark sensor unit 210. End-mark sensor unit 210 is disposed between the above-described roll holder 202 and recording unit 203. The details of end-mark sensor unit 210 will be described with reference to FIGS. 8(*a*) and 8(*b*).

Paper guides 210*c* and 210*d* are provided between roll holder 202 and recording unit 203. Thermosensitive recording sheet 201 passes through a space between paper guides 210*c* and 210*d*. A black end mark (having a Macbeth density of about at least 1.1) having a predetermined width (about 20 mm) is printed on the back opposite to the recording surface of thermosensitive recording sheet 201 over a predetermined length (about 1 m) from the rear end of the sheet. The end mark is always printed at the same position in the direction of the width. A hole and a reflecting plate 210*b* of the sensor are provided at lower sheet guide 210*c* and upper sheet guide

210*d*, respectively, so as to face each other at the same position in the direction of the width. Reflection-type photosensor 210*a* is provided below the hole of lower sheet guide 210*c*.

Reflection-type photosensor 210*a* is a unit in which a light-emitting diode and a phototransistor are fixed substantially in the same direction. Light emitted from the light-emitting diode is reflected by an object to be measured, and light reflected by the object is received by the phototransistor. As shown in FIG. 9, current I of circuitry connected to the phototransistor is changed in accordance with the amount of the received light. The output current I changes in accordance with the distance d between the object and the reflection-type photosensor. The relationship between current I and distance d has characteristics as shown in FIG. 9. In FIG. 9, curve A represents characteristics when white on the back opposite to the recording surface is measured, and curve B represents characteristics when black of the end-mark sensor is measured. Based on the characteristics shown in FIG. 9, the distance between reflection-type photosensor 210*a* and the sheet-guide surface of lower sheet guide 210*c* is set to $d_1$, the distance between reflection-type photosensor 210*a* and the sheet-guide surface of upper sheet guide 210*d* is set to $d_2$. Thus, the values of the current are within ranges $I_W$ and $I_B$ for white background and black of the end mark, respectively, so that the difference in the values of current for white and black has the largest value, and outputs having only small variations are obtained even if the position of recording paper changes between the sheet guides.

A gray reflecting plate 210*b*, shown in FIG. 8(*b*), having a reflectivity value which is substantially intermediate between those of white and black, is provided at upper sheet guide 210*d* above the hole of lower sheet guide 210*c*. When thermosensitive recording paper is absent, reflection-type photosensor 210*a* measures the surface of reflecting plate 210*b*. Curve $I_R$ shown in FIG. 9 represents characteristics obtained when reflecting plate 210*b* is measured. The distance between reflection-type photosensor 210*a* and reflecting plate 210*b* is $d_2$, and the reflectivity of reflecting plate 210*b* is set so that output $I_R$ corresponding to the gray reflecting plate 210*b* has a value which is substantialy intermediate between output $I_W$ for white of the recording sheet and output $I_B$ for black of the end mark. The output of reflection-type photosensor 210*a* is digitized by an A/D converter, and is classified into regions C, D and E according to thresholds $S_1$ and $S_2$ by a CPU (central processing unit). Region C indicates that recording paper is present in a normal state, and region D indicates that recording paper is absent. Region E indicates that the end mark has been detected.

Figure 11:
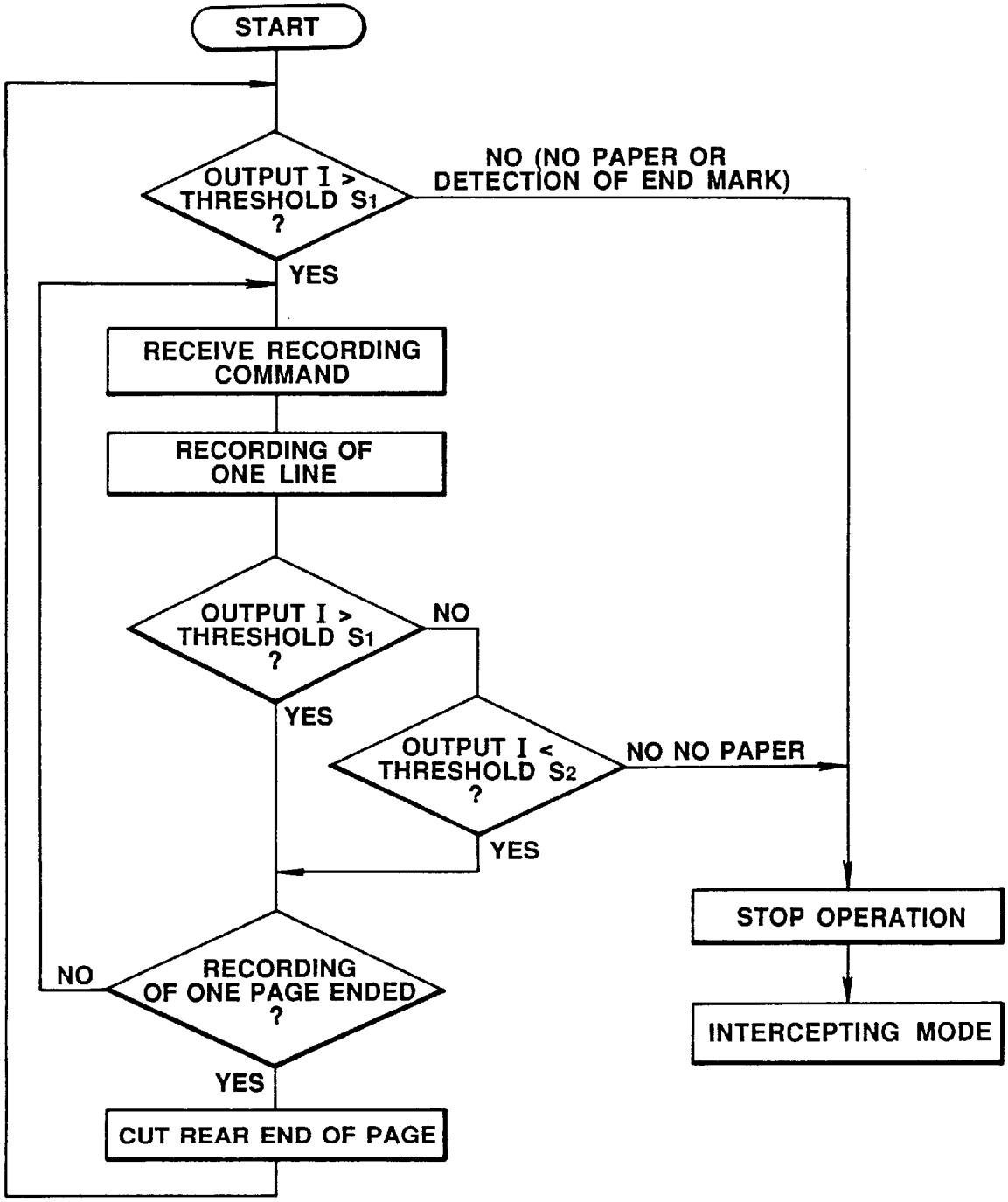
FIG. 11 is a flowchart illustrating the operation of the recorder of the third embodiment.

Next, the operation of the present embodiment will be described. FIG. 11 illustrates the relationship between the recording operation and detection of the end mark.

First, the presence of recording paper is confirmed. When recording paper is absent, or the remaining amount of recording paper is small, that is, in the case of region D or E, the operation is immediately stopped, and the mode is switched to an intercepting mode in which received image data is directly stored in a memory of the apparatus. When recording paper is present in a normal state, it is determined that the apparatus is in region C, and the apparatus assumes a waiting state until receiving a recording command. After receiving a recording command (for one line), information for one line is recorded, and the state of the end-mark sensor is determined. When the state of the absence of recording paper has been detected, the operation is immediately stopped, and the mode is switched to the intercepting mode. Even when the end mark has been detected, recording is continued, since the remaining amount of recording paper is about 1 m and the page being recorded may be normally recorded. This operation is repeated until the end of one page. When printing of one page has been completed, the trailing edge of the image is cut, and the process returns to the initial state of detecting the end mark.

Accordingly, even if recording paper not having an end mark is used, the mode is promptly switched to the intercepting mode when the recording paper is used up during a recording operation. Furthermore, even if an end mark appears and recording paper is used up while recording an abnormally long page, the mode is switched to the intercepting mode.

In the above-described third embodiment, when the end mark or the absence of recording paper has been detected in a waiting state, or when the absence of recording paper has been detected during a recording operation, the mode is switched to the intercepting mode. However, certain effects may also be obtained, for example, by merely interrupting the operation, or by prohibiting the receiving operation.

Although in the third embodiment, the output of the reflection-type photosensor is digitized by an A/D converter, simple circuitry, such as a differential amplifier or the like, may also be used, thereby causing an advantage in the production cost.

Although in the third embodiment, the output of the reflection-type sensor is detected in terms of current, the circuitry may also be easily configured so as to detect voltage, thereby simplifying the circuitry. In addition, the output voltage may be proportional or inversely proportional to the output current depending on the configuration of the circuitry.

Although the third embodiment relates to a recorder which uses rolled paper, cut paper may also be used.

Fourth Embodiment

Figure 12:
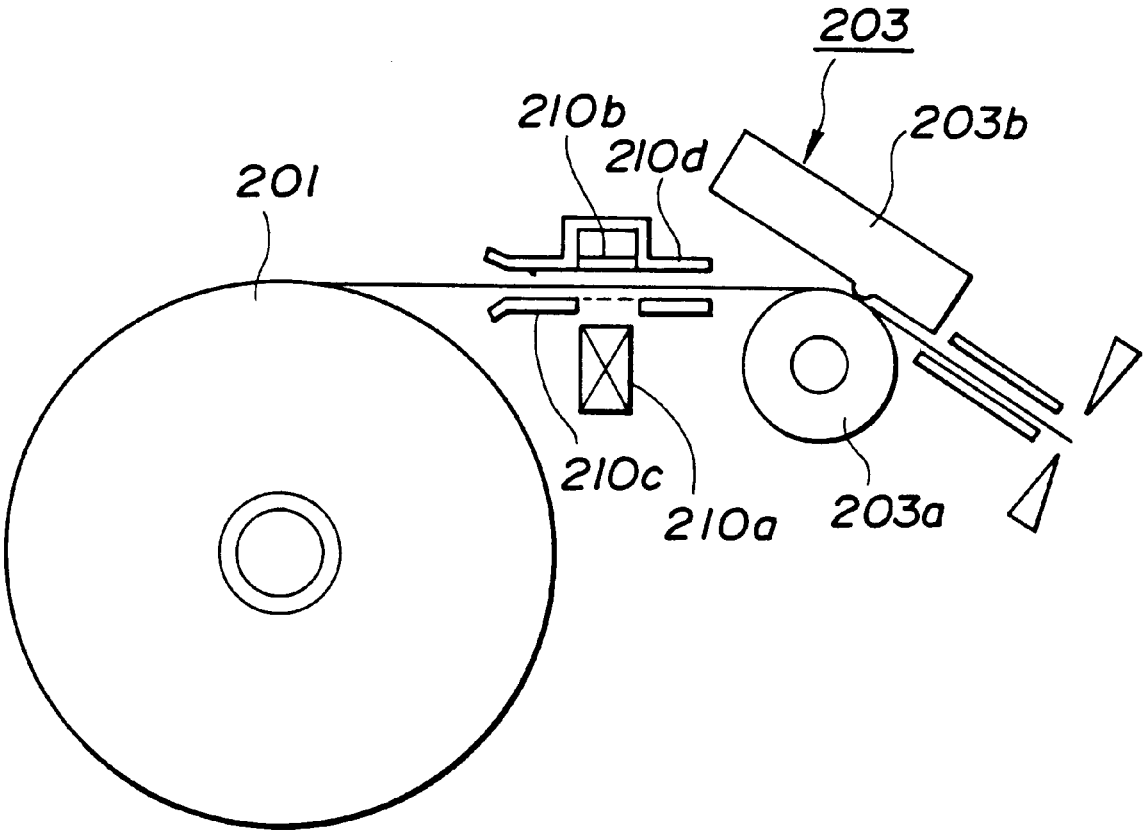
FIG. 12 is a cross-sectional view illustrating the schematic configuration of a principal portion of a recorder according to a fourth embodiment of the present invention.
Figure 13:
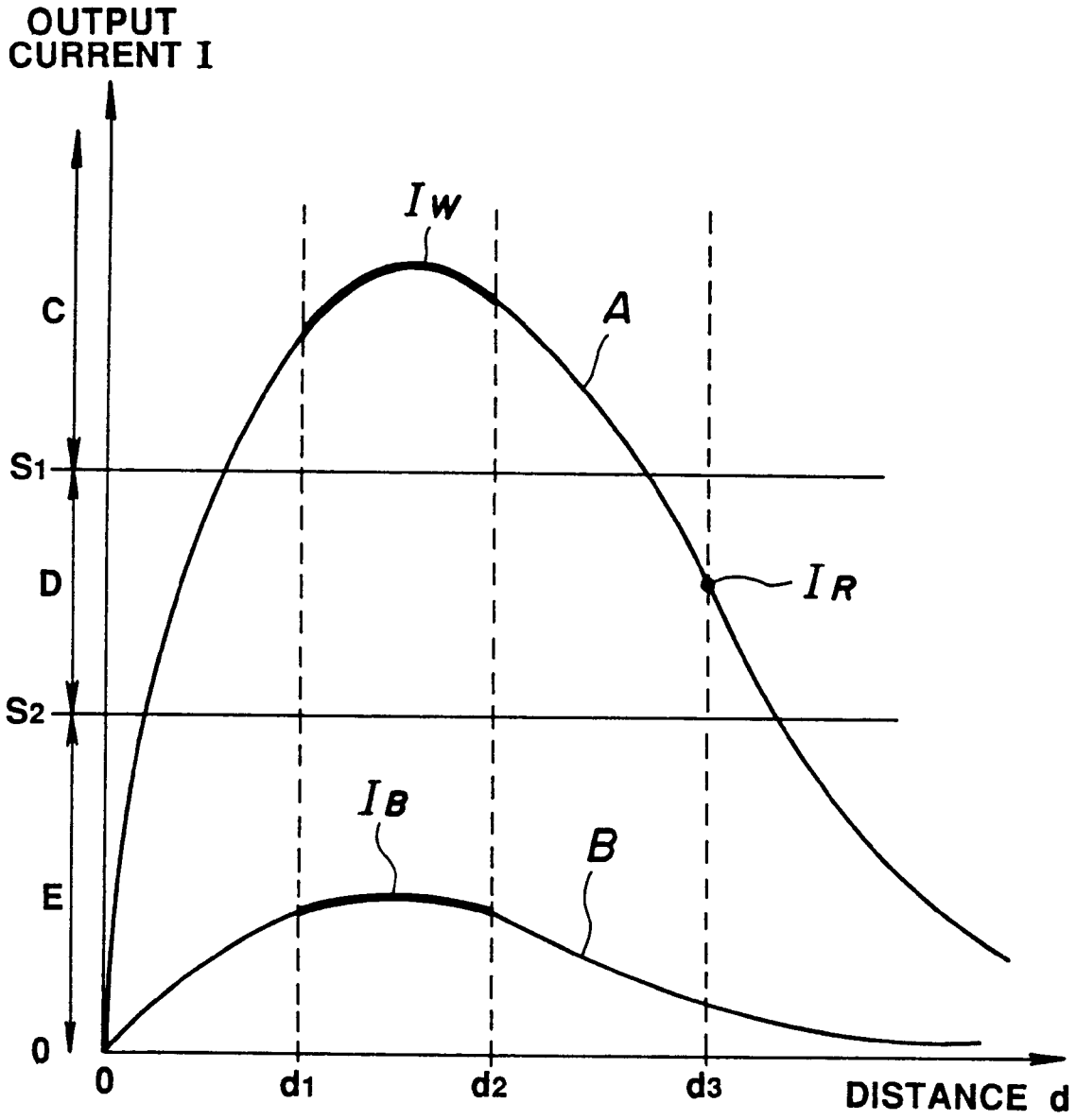
FIG. 13 is a graph illustrating the operation of the recorder of the fourth embodiment.
Figure 14:
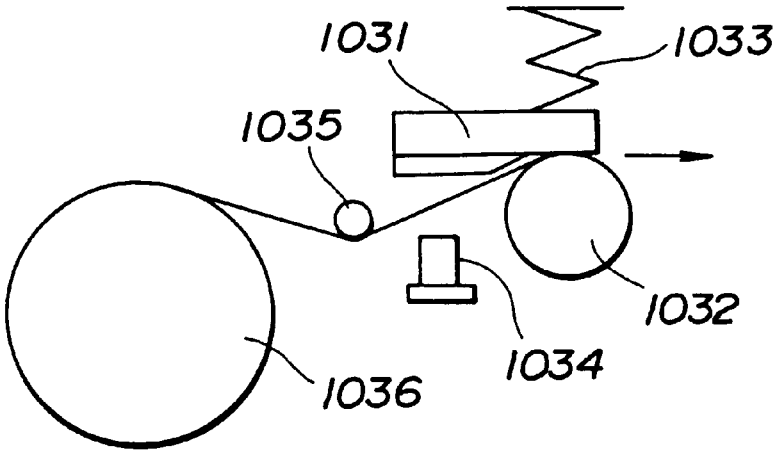
FIG. 14 is a diagram illustrating the schematic configuration of a principal portion of a conventional recorder.
Figure 15:
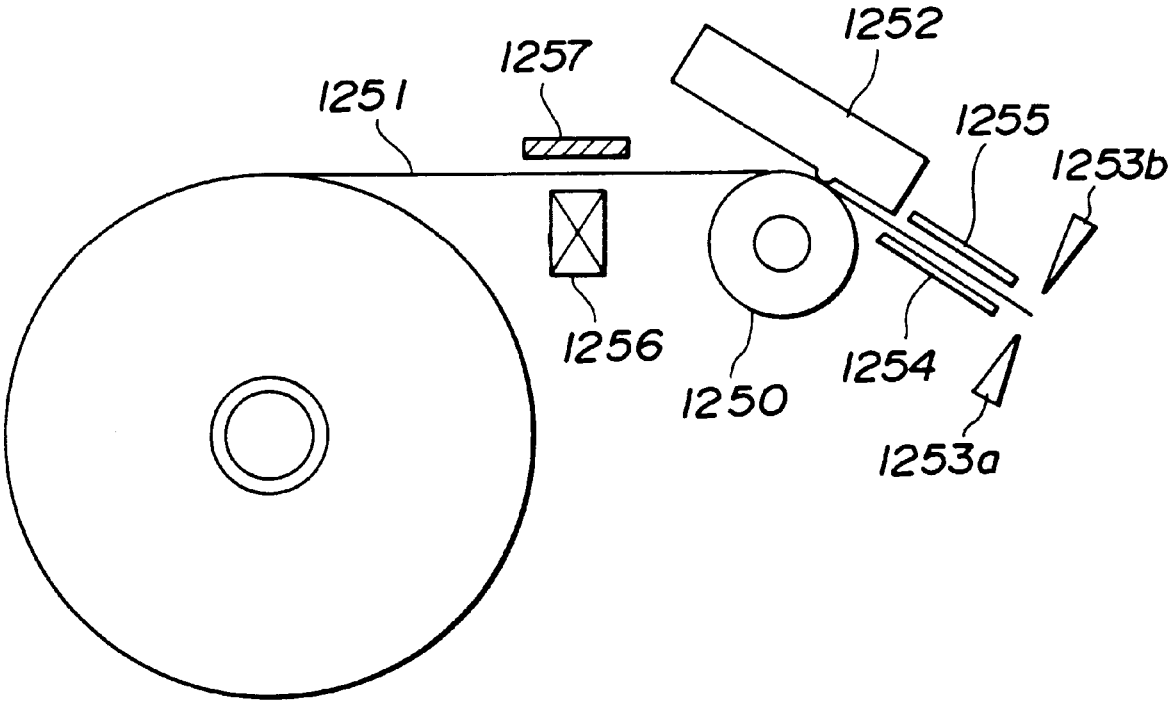
FIG. 15 is a cross-sectional view illustrating the schematic configuration of a principal portion of another conventional recorder.
Figure 16:
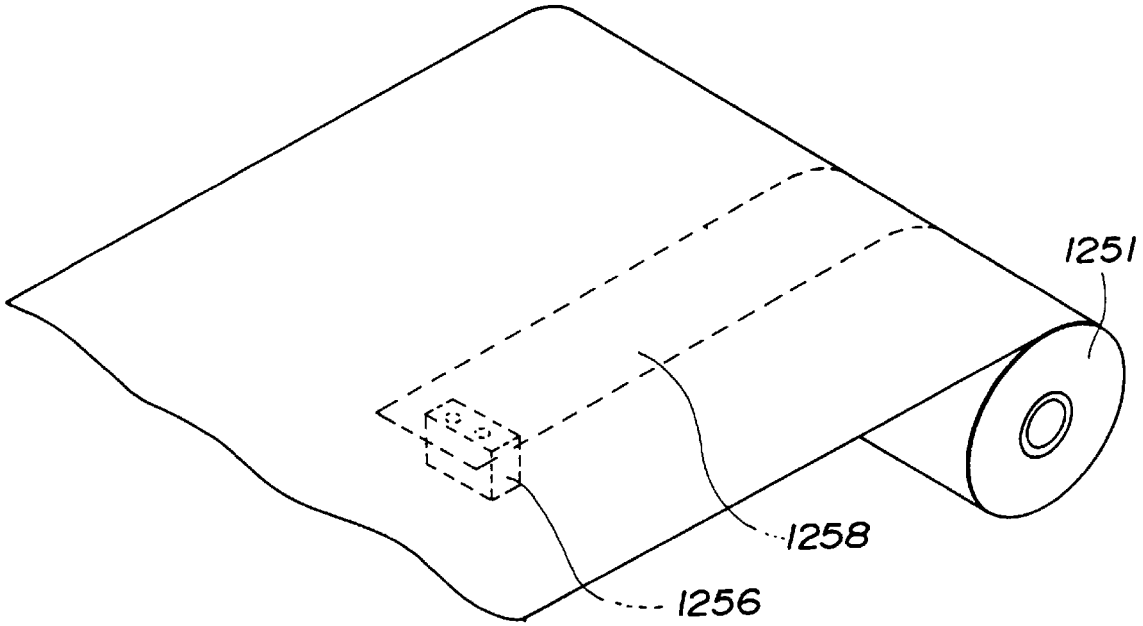
FIG. 16 is a perspective view of a part of the recorder shown in FIG. 15.

FIGS. 12 and 13 illustrate a fourth embodiment of the present invention. In the third embodiment, gray reflecting plate 210*b* having a reflectivity value which is substantially intermediate between those of white and black is provided at distance $d_2$ from end-mark sensor 210*a*. In the fourth embodiment, however, a white reflecting plate 210*b*, having a reflectivity value substantially the same as that of the back of thermosensitive recording paper 201, is provided at distance $d_3$ from end-mark sensor 210*a*. As shown in FIG. 13, distance $d_3$ is set so that output $I_R$ corresponding to white reflecting plate 210*b* has a value which is substantially intermediate between output $I_W$ for white of the recording paper and output $I_B$ for black of the end mark.

The above-described fourth embodiment has the same effects as the third embodiment.

As described above, in a recorder of the present invention, one detection means detects whether recording paper comprises rolled paper or cut paper. In the case of cut paper, the detection means also detects the leading edge and the trailing edge of the cut paper. Hence, it is unnecessary to provide separate detection means for detecting the leading edge and the trailing edge of cut paper, and it is possible to use both rolled paper and cut paper as recording paper.

In addition, by fixing the detection means to the recording means, it is possible to maintain the detection means at a constant position without being influenced, for example, by variations in the mounting position of the recording means.

In another feature of the present invention, by providing guide means only in the vicinity of the central portion in the direction of the width of recording paper, it is possible to prevent oblique movement of the recording paper.

In another feature of the present invention, by setting the reflectivity of a reflecting plate of a reflection-type photosensor so that the relationship among output current $I_W$, $I_B$ and $I_R$ of the reflection-type photosensor for a white portion of recording paper, an end mark of the recording paper, and the reflecting plate, respectively, is $I_B<I_R<I_W$, it is possible to identify a state in which the remaining amount of the recording paper is so small that missing of a received image occurs, a state in which the remaining amount of the recording paper is sufficient enough to prevent missing of a received image, and a state in which the recording paper is used out. When an end mark has been detected, recording is continued for the page being received, and the mode is switched to an intercepting mode after the subsequent page, so that recording is switched at the end of a page. As a result, it is unnecessary to connect a recorded portion to the succeeding portion subjected to intercepting, and received images are easy to see since there is no connected portions.

Furthermore, even if recording paper is used up during a receiving and recording operation, the mode is immediately switched to an intercepting mode, thereby preventing misprinting of a received image.

In addition, since it is necessary to provide only a single sensor, the apparatus has, for example, the advantage of reducing the production cost.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet guiding apparatus comprising:

a guiding path for guiding a sheet;

detection means for detecting the presence/absence of the sheet in said guiding path;

a power-supply switch for turning on and off a power supply;

control means which determines that the sheet is a rolled sheet if said detection means detects the sheet when said power-supply switch has been turned on, and determines that a leading edge of the sheet has passed if said detection means has detected no sheet when said power-supply switch has been turned on and then said detection means detects the sheet; and a rolled sheet holder for holding a rolled sheet, said rolled sheet holder being attachable to said sheet guiding apparatus, said rolled sheet holder covering an insertion port of said guiding path when said rolled sheet holder is attached to said sheet guiding apparatus.

2. An apparatus according to claim 1, wherein said rolled sheet holder comprises a guide for guiding the rolled sheet to said insertion port when said rolled sheet holder is attached to said sheet guiding apparatus.

3. An image forming apparatus comprising:

image forming means for forming an image on a sheet;

feeding means for feeding the sheet while pressing the sheet against said image forming means;

detection means for detecting whether the sheet is present at a predetermined position at an upstream side of said feeding means;

a power-supply switch for turning on and off a power supply;

control means which determines that the sheet is a rolled sheet if said detection means detects the sheet when said power-supply switch has been turned on, and determines that a leading edge of the sheet has passed if said detection means has detected no sheet when said power-supply switch has been turned on and then said detection means detects the sheet, and for controlling said feeding means based on a result of that determination;

a rolled sheet holder for holding a rolled sheet, said rolled sheet holder being attachable to said image forming apparatus and;

an insertion port for leading a cut sheet or the rolled sheet to said feeding means, wherein said rolled sheet holder comprises a guide for guiding the rolled sheet to said insertion port when the rolled sheet holder is attached to said image forming apparatus;

said rolled sheet holder covering said insertion port when said rolled sheet holder is attached to said image forming apparatus.

4. An image forming apparatus comprising:

image forming means for forming an image on a sheet;

feeding means for feeding the sheet while pressing the sheet against said image forming means;

detection means for detecting whether the sheet is present at a predetermined position at an upstream side of said feeding means;

a power-supply switch for turning on and off a power supply;

control means for determining whether the sheet comprises a rolled sheet or a cut sheet, according as said detection means detects or does not detect the sheet, respectively, when said power-supply switch has been turned on, and for controlling said feeding means based on a result of that determination, wherein said control means controls said feeding means so as to feed the sheet in accordance with whether the sheet comprises a rolled sheet or a cut sheet, after a completion of the image formation;

a rolled sheet holder for holding a rolled sheet, said rolled sheet holder being attachable to said image forming apparatus; and an insertion port for leading the cut sheet or the rolled sheet to said feeding means, wherein the rolled sheet holder comprises a guide for guiding the rolled sheet to said insertion port when said rolled sheet holder is attached to said image forming apparatus;

said rolled sheet holder covering said insertion port when said rolled sheet holder is attached to said image forming apparatus.

5. A sheet feeding apparatus comprising:

holding means for holding a rolled sheet;

feeding means for feeding the rolled sheet while drawing the sheet from said holding means;

a rotating member disposed between said holding means and said feeding means for guiding the sheet in contact therewith only in the vicinity which includes a central portion in a width direction;

a detachable cover for holding said holding means and said rotating member; and an insertion port for leading a cut sheet or the rolled sheet to said feeding means, wherein the detachable cover comprises a guide for guiding the rolled sheet to said insertion port when said detachable cover is attached to said sheet feeding apparatus;

said detachable cover covering said insertion port when said holding means is attached to a sheet feeding apparatus.

6. An image forming apparatus comprising:

feeding means for feeding a sheet;

image forming means for forming an image on the sheet being fed by said feeding means;

detection means for detecting whether the sheet is present at a predetermined position at an upstream side of said feeding means;

a power-supply switch for turning on and off a power supply;

control means for controlling said feeding means in forming the image on the sheet by said image forming means so that, if said detection means detects the sheet when said power-supply switch has been turned on, said feeding means feeds the sheet forward for formation of the image on the sheet, and if said detection means detected no sheet when said power-supply switch was turned on and then said detection means detects the sheet, said feeding means feeds the sheet until a leading portion of the sheet reaches said image forming means, and then feeds the sheet forward to form the image on the sheet;

a rolled sheet holder for holding a rolled sheet, said rolled sheet holder being attachable to said image forming apparatus and;

an insertion port for leading a cut sheet or the rolled sheet to said feeding means, said rolled sheet holder comprising a guide for guiding the rolled sheet to said insertion port when the rolled sheet holder is attached to said image forming apparatus;

said rolled sheet holder covering said insertion port when said rolled sheet holder is attached to said image forming apparatus.

7. An image forming apparatus comprising:

feeding means for feeding a sheet;

image forming means for forming an image on the sheet being fed by said feeding means;

detection means for detecting whether the sheet is present at a predetermined position at an upstream side of said feeding means;

a power-supply switch for turning on and off a power supply; and control means for controlling said feeding means so that after completion of image forming, if said detection means detected the sheet when said power-supply switch was turned on, said feeding means feeds the sheet until a part on which the image has been formed is fed out of a main body of the apparatus, and if said detection means detected no sheet when said power-supply switch was turned on and then said detection means detects the sheet, said feeding means feeds the sheet until a trailing end of the sheet passes out of said feeding means; and a rolled sheet holder for holding a rolled sheet, said rolled sheet holder being attachable to said image forming apparatus; and an insertion port for leading a cut sheet or the rolled sheet to said feeding means, wherein said rolled sheet holder comprises a guide for guiding the rolled sheet to said insertion port when said rolled sheet holder is attached to said image forming apparatus;

said rolled sheet holder covering said insertion port when said rolled sheet holder is attached to said image forming apparatus.

8. An image forming apparatus comprising:

feeding means for feeding a sheet;

image forming means for forming an image on the sheet being fed by said feeding means;

an insertion port for guiding a cut sheet or a rolled sheet to said feeding means;

a rolled sheet holder for holding the rolled sheet, said rolled sheet holder being attachable to said image forming apparatus;

a guide arranged in said rolled sheet holder, for guiding the rolled sheet to said insertion port when said rolled sheet holder is attached to said image forming apparatus, said sheet holder covering said insertion port when said rolled sheet holder is attached to said image forming apparatus.

* * * * *

UNITED STATES PATENT AND TRADEMARK OFFICE

CERTIFICATE OF CORRECTION

PATENT NO. : 5,920,743

DATED : July 6, 1999

INVENTOR(S) : MASAKATSU YAMADA ET AL.

It is certified that error appears in the above-identified patent and that said Letters Patent is hereby corrected as shown below:

Title page, item [57]

IN THE ABSTRACT

Line 5, "determination" should read --determining--.

COLUMN 11

Line 11, "out." should read --up.--.

Signed and Sealed this

Eighth Day of February, 2000

*Attest:*

*Attesting Officer*

Q. TODD DICKINSON

*Commissioner of Patents and Trademarks*